US011420849B2

(12) United States Patent
Liu et al.

(10) Patent No.: US 11,420,849 B2
(45) Date of Patent: Aug. 23, 2022

(54) TRACTION MACHINE AND LIFTING EQUIPMENT

(71) Applicant: Ficont Industry (Beijing) Co., Ltd., Beijing (CN)

(72) Inventors: Zizhao Liu, Beijing (CN); Qingwei Zhang, Beijing (CN); Guozhu Zhang, Beijing (CN)

(73) Assignee: Ficont Industry (Beijing) Co., Ltd., Beijing (CN)

( * ) Notice: Subject to any disclaimer, the term of this patent is extended or adjusted under 35 U.S.C. 154(b) by 379 days.

(21) Appl. No.: 16/513,456

(22) Filed: Jul. 16, 2019

(65) Prior Publication Data

US 2020/0055704 A1 Feb. 20, 2020

(30) Foreign Application Priority Data

Aug. 17, 2018 (CN) ..... 201810941508.X

(51) Int. Cl.
*B66B 11/04* (2006.01)
*B66B 1/30* (2006.01)
(Continued)

(52) U.S. Cl.
CPC ..... *B66B 11/043* (2013.01); *B66B 1/30* (2013.01); *B66B 1/32* (2013.01); *B66B 1/3492* (2013.01);
(Continued)

(58) Field of Classification Search
CPC ..... B66B 11/043; B66B 9/06; B66B 9/187; B66B 7/04; B66B 7/042; B66B 7/022;
(Continued)

(56) References Cited

U.S. PATENT DOCUMENTS 3,908,801 A * 9/1975 Pohlman ..... B66B 5/04 187/313
4,183,423 A * 1/1980 Lewis ..... B66B 9/16 182/103
(Continued)

FOREIGN PATENT DOCUMENTS

CN 201071290 Y * 6/2008 ..... E06C 7/187
CN 204111089 U * 1/2015 ..... B66B 1/06
(Continued)

OTHER PUBLICATIONS

Rinklake, Kai, Collecting Device with Centrifugal Clutch, Aug. 22, 2007, machine translation of EP 1820539 A1 (Year: 2007).*
(Continued)

*Primary Examiner* — Michael R Mansen
*Assistant Examiner* — Michelle M Lantrip
(74) *Attorney, Agent, or Firm* — Seed Intellectual Property Law Group LLP

(57) ABSTRACT

The present application relates to the technical field of lifting equipment, and provides a traction machine and a lifting equipment. The traction machine includes traction pulleys, traction ropes driven by the traction pulleys and fixed pulleys for changing directions of the traction ropes. The fixed pulley is provided with a sensor sensing member rotating with the fixed pulley, a traction machine sensor is arranged beside the fixed pulley; the traction machine sensor is configured to detect a rotation speed of the sensor sensing member, and send the rotation speed to a controller of the traction machine; the controller controls a rotation of the traction pulley according to detected data of the traction machine sensor. Since this kind of traction machine is provided with the sensor sensing member and the traction machine sensor, it is capable of detecting whether the
(Continued)

traction machine has an abnormal operation, and stopping the traction machine immediately in an abnormal state.

20 Claims, 17 Drawing Sheets

(51) Int. Cl.

| | |
|---|---|
| ***B66B 1/32*** | (2006.01) |
| ***B66B 1/34*** | (2006.01) |
| ***B66B 5/00*** | (2006.01) |
| ***B66B 5/04*** | (2006.01) |
| ***B66B 5/18*** | (2006.01) |
| ***B66B 9/00*** | (2006.01) |
| ***B66B 11/00*** | (2006.01) |
| ***E06C 7/18*** | (2006.01) |
| ***B66B 5/28*** | (2006.01) |

(52) U.S. Cl.
CPC ..... *B66B 5/0031* (2013.01); *B66B 5/044* (2013.01); *B66B 5/18* (2013.01); *B66B 9/00* (2013.01); *B66B 11/005* (2013.01); *E06C 7/187* (2013.01); *B66B 5/28* (2013.01)

(58) Field of Classification Search
CPC ..... B66B 11/005; B66B 9/00; B66B 7/046; B66B 7/02; B66B 1/30; B66B 1/32; B66B 1/3492; B66B 5/0031; B66B 5/044; B66B 5/28; B66B 5/18; E06C 7/12; E06C 7/16; E06C 7/187; E06C 7/18; E06C 1/39; B66F 11/04; B66F 9/08
See application file for complete search history.

(56) References Cited

U.S. PATENT DOCUMENTS 6,533,070 B1 * 3/2003 Elrod ..... E06C 1/345 182/103
8,974,334 B2 * 3/2015 Stephenson ..... B66D 1/7489 474/138
9,834,944 B2 * 12/2017 Maurer ..... B66B 9/187
2003/0031546 A1 * 2/2003 Araki ..... E06C 7/12 414/618
2007/0158137 A1 * 7/2007 Petersen ..... E06C 7/186 182/8
2010/0219015 A1 * 9/2010 Meillet ..... E06C 7/186 182/8
2010/0219016 A1 * 9/2010 Meillet ..... F16D 63/006 182/8
2013/0095968 A1 * 4/2013 Stephenson ..... B66D 1/7405 474/137

FOREIGN PATENT DOCUMENTS

CN 204281227 U * 4/2015
CN 105084186 A * 11/2015 ..... B66B 1/06
CN 205034931 U * 2/2016 ..... A62B 35/0081
DE 202005019665 U1 * 5/2007 ..... F03D 80/50
EP 1820539 A1 * 8/2007 ..... E06C 7/187
EP 2514486 A2 * 10/2012 ..... A62B 35/0081

OTHER PUBLICATIONS

Zhong, Cheng-fei, A Lifting Device, Jun. 11, 2008, machine translation of CN 201071290 Y (Year: 2008).*
Szlachcikowski, Miroslaw, Arresting Device For a Fall Protection System, Oct. 24, 2012, machine translation of EP 2514486 A2 (Year: 2012).*
Liu, Zhi-xin, An Electric Control System Without the Climbing Device, Jan. 21, 2015, machine translation of CN 204111089 U (Year: 2015).*

* cited by examiner

TRACTION MACHINE AND LIFTING EQUIPMENT

BACKGROUND

Technical Field

The present application relates to the field of lifting equipment, and specifically to a traction machine and a lifting equipment.

Description of the Related Art

The existing traction machine plays an important role in the ascending and descending of the lifting equipment. During the ascending of the lifting equipment, the power is mainly provided by the traction machine; while during the descending of the lifting equipment, the braking force is mainly provided by the traction machine to the lifting equipment.

During the operation, the existing traction machine may be in states where the fixed pulley is slipping, the traction rope is over-speed or the traction machine is not in operation, which will lead to that the lifting speed of the lifting equipment is not controlled. Therefore, it is necessary to provide a traction machine capable of monitoring the working state.

In addition, during the descending of the lifting equipment, in order to control the speed of the lifting equipment, the bus voltage of the controller of the traction machine will be changed, thereby affecting the stability of the controller.

BRIEF SUMMARY

The present application aims to solve at least one of the technical problems existing in the prior art or the related art.

One of the objectives of the present application is to provide a traction machine and a lifting equipment to solve the technical problem existing in the prior art that once the traction machine is slipping, the traction rope is over-speed or the traction machine is not in operation, the lifting speed of the lifting equipment would not be controlled.

In order to achieve the objective, the present application provides a traction machine, including traction pulleys, traction ropes driven by the traction pulleys and fixed pulleys for changing directions of the traction ropes; wherein the fixed pulley is provided with a sensor sensing member rotating with the fixed pulley, a traction machine sensor is arranged beside the fixed pulley; the traction machine sensor is configured to detect a rotation speed of the sensor sensing member, and send the rotation speed to a controller of the traction machine; the controller controls a rotation of the traction pulley according to detected data of the traction machine sensor.

Since this kind of traction machine is provided with the sensor sensing member and the traction machine sensor, it is capable of detecting whether the traction machine has an abnormal operation, and stopping the traction machine in an abnormal state.

According to an embodiment of the present application, the controller of the traction machine is connected to the bus of the controller, and the bus of the controller is provided with a resistance module.

Since the resistance module is provided, when the bus voltage of the controller of the traction machine increases, the resistance module will automatically generate heat and convert the additional electric energy into the heat energy of the resistance module to be consumed, so that the bus voltage of the controller of the traction machine is maintained within a safe range.

The other objective of the present application is to provide a lifting equipment, including the traction machine above; wherein the lifting equipment further includes a climbing member, a guide rail and a lifting vehicle; the guide rail is arranged on the climbing member.

According to an embodiment of the present application, the guide rail is provided with a closing groove extending along a longitudinal direction of the guide rail, and an anti-falling device capable of ascending and descending along the guide rail is mounted on the lifting vehicle; the anti-falling device includes an anti-falling main body embedded in the closing groove; the anti-falling main body is provided with first rollers in the closing groove and capable of sliding along an inner wall of the closing groove; the anti-falling device further includes a second roller arranged at an opening of the closing groove and capable of sliding along the opening.

According to an embodiment of the present application, a number of the first rollers is at least two, and the first rollers are mounted on both sides of the anti-falling main body through a first roll shaft; the second roller is mounted to a front surface of the anti-falling main body through a second roll shaft, and the second roll shaft is perpendicular to the first roll shaft.

According to an embodiment of the present application, one side away from the closing groove of the second roller is provided with a wear plate; the second roll shaft is fixed to the lifting vehicle by sequentially penetrating through the anti-falling main body, the second roller, a first positioning sleeve and the wear plate; the wear plate is mounted to the second roll shaft through the first positioning sleeve.

According to an embodiment of the present application, a first elastic member capable of extending and retracting along a second roll shaft direction is arranged between the second roller and the anti-falling main body.

According to an embodiment of the present application, the second roller is connected to an upper portion of the anti-falling main body, and a lower portion of the anti-falling main body is provided with a second positioning sleeve; the second positioning sleeve is mounted to the front surface of the anti-falling main body through a third roll shaft which is parallel to the second roll shaft; and a second elastic member capable of extending and retracting along a length direction of the third roll shaft is arranged between the second positioning sleeve and the anti-falling main body.

According to an embodiment of the present application, the lifting equipment further includes a stall braking device mounted on the lifting vehicle; the stall braking device includes a speed-limiting assembly and a safety protection assembly.

According to an embodiment of the present application, the speed-limiting assembly includes a speed measuring wheel, a centrifugal block and a braking cam; the centrifugal block is fixed to the speed measuring wheel and rotates with the speed measuring wheel, and the centrifugal block satisfies: when a rotation speed of the speed measuring wheel is not less than a set speed, the centrifugal block opens and connects the braking cam so as to drive the braking cam to rotate.

According to an embodiment of the present application, the speed measuring wheel and the centrifugal block are fixedly mounted on a main shaft, and the speed measuring wheel drives the centrifugal block to rotate through the main shaft; the braking cam is fixedly mounted on a transmission shaft, and the centrifugal block is connected to the transmission shaft through a transmission sleeve when opened.

According to an embodiment of the present application, the main shaft is provided with a first through hole in a radial direction; after a centrifugal spring passes through the first through hole, each of two ends of the centrifugal spring is fixed with a centrifugal block, respectively; lugs are formed on the main shaft, and the lug is provided with a second through hole extending axially along the main shaft; the centrifugal block is hinged to the second through hole through a pin shaft, so that the centrifugal block rotates with the second through hole as an axis and opens.

According to an embodiment of the present application, a first circumferential limiting member is formed on an outer surface of the centrifugal block, and a second circumferential limiting member is formed on an inner surface of the transmission sleeve; when the centrifugal block opens, the first circumferential limiting member and the second circumferential limiting member are circumferentially locked.

According to an embodiment of the present application, the outer surface of the centrifugal block includes two first involute surfaces, and the first circumferential limiting member is formed between the first involute surfaces; the inner surface of the transmission sleeve includes two second involute surfaces, and the second circumferential limiting member is formed between the second involute surfaces.

According to an embodiment of the present application, the safety protection assembly includes a locking block hinged on the lifting vehicle; and when the lifting vehicle operates normally, the locking block compresses a spring, and when the lifting vehicle stalls, the spring ejects the locking block so that the locking block is embedded in a locking hole of the guide rail.

According to an embodiment of the present application, one side facing the climbing member of the guide rail is provided with friction protrusions.

According to an embodiment of the present application, the top portion of the guide rail is mounted with guiding pulleys for the traction rope, and the bottom portion of the guide rail is provided with a tensioning device for the traction rope.

According to an embodiment of the present application, the lifting vehicle is connected to the traction rope, and the climbing member is provided with a traction rope protection assembly; the traction rope protection assembly includes idler rollers and a mounting bracket for mounting the idler rollers to the climbing member; a rotation direction of the idler roller is perpendicular to a lifting direction of the traction rope, and the idler rollers are between the climbing member and the traction rope.

According to an embodiment of the present application, a double-hand switch is provided on the lifting vehicle.

According to an embodiment of the present application, triggering blocks are arranged on the climbing member or the guide rail corresponding to places where space changes; when the lifting vehicle runs to the triggering block, the triggering block sends current position information to the controller, and the controller controls an operating speed of the lifting vehicle according to the position information.

BRIEF DESCRIPTION OF THE SEVERAL VIEWS OF THE DRAWINGS

In order to more clearly illustrate the technical solutions of the embodiments of the present application or the prior art, a brief description of the drawings to be used in the embodiments or the description of the prior art will be made hereinafter. Obviously, the drawings described below are only some embodiments of the present application, and those of ordinary skill in the art can obtain other drawings according to these drawings without any creative work.

Figure 1:
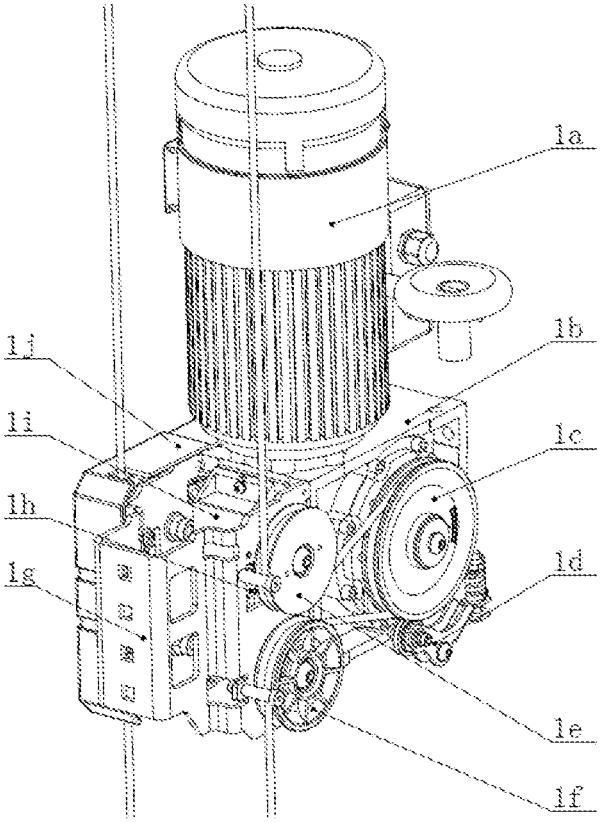
FIG. 1 is a structural diagram of the traction machine according to an embodiment.

In the drawings: 1*a*, motor; 1*b*, speed reducer; 1*c*, traction pulley; 1*d*, pressing pulley; 1*e*, first fixed pulley; 1*f*, second fixed pulley; 1*g*, machine fixing frame; 1*h*, traction machine sensor; 1*i*, resistance module; 1*j*, machine shield; 1*k*, sensor sensing member; 2*h*, anti-falling device; 2*i*, safety protection assembly; 2*h*-1, wear plate; 2*h*-2, first roller; 2*h*-3, first roll shaft; 2*h*-4, anti-falling main body; 2*h*-5, third roll shaft; 2*h*-6, second positioning sleeve; 2*h*-7, second elastic member; 2*h*-8, second roller; 2*h*-9, first positioning sleeve; 2*h*-10, second roll shaft; 2*i*-1, safety protection main body; 2*i*-2, safety protection assembly spring; **2*i*-3, safety protection assembly rotation shaft; 2*i*-4, locking block; 2*i*-5, safety protection assembly roller; 1, lifting vehicle; 2, stall braking device; 3, guide rail; 4, speed-limiting assembly; 5, fastener; 6, elastic cylindrical pin; 8, braking cam; 9, supporting side plate; 10, compression spring; 11, bearing; 12, return spring; 13, fixing bolt; 14, adjusting bolt; 15, top plate; 16, lug; 17, speed measuring wheel; 18, shaft elastic check ring; 19, centrifugal block; 20, centrifugal spring; 21, main shaft; 22, transmission sleeve; 23, cam half shaft; 24, bearing housing; 25, spacer; 26, limiting bolt; 27, first through hole; 28, second through hole; 29, pin hole; 30, first involute surface; 31, first limiting stair; 32, second involute surface; 33, second limiting stair; 01, traction machine; 03, controller; 04, first limiting device; 05, first fixed pulley assembly; 06, buffering device; 07, traction rope; 08, triggering block; 09, traction rope protection assembly; 011, second limiting device; 012, second fixed pulley assembly; 013, climbing member; 014, controller bus; 2*a*, platform anti-collision device; 2*b*, handle switch; 2*c*, limiting sensor; 2*d*, triggering plate; 2*e*, wireless transmitting device; 2*f*, battery; 2*j*, manual braking device; 2*g*, walking pulley; 5*a*, tensioning support; 5*b*, tensioning spring; 5*c*, guiding support; 9*a*, baffle; 9*b*, mounting bracket; 9*c*, idler roller; 010**, friction protrusion.

DETAILED DESCRIPTION

In order to more clearly understand the above objectives, features and advantages of the present application, the present application will be further described in detail hereinafter with reference to the drawings and specific embodiments. It should be noted that, the embodiments and the features therein of the present application may be combined with each other without conflict.

In the description of the present application, it should be noted that the orientational or positional relations indicated by the terms "central," "longitudinal," "lateral," "upper," "lower," "front," "rear," "left," "right," "vertical," "horizontal," "top," "bottom," "inner," "outer," etc., are based on the orientational or positional relations shown in the drawings, and are only for the convenience of describing the present application and simplifying the description, but not indicating or implying that the indicated device or component must have the specific orientations, be constructed and operated in the specific orientations, which, therefore, cannot be construed as limiting the present application. In addition, the terms "first," "second," and "third" are for the descriptive purpose only and are cannot be construed as indicating or implying the relative importance.

In the description of the present application, it should be noted that unless specifically defined or limited otherwise, the terms "connect to" and "connect with" should be understood in a broad sense. For example, they may be fixed connections, removable connections, or integral connections; they may be mechanical connections or electrical connections; they may be direct connections or indirect connections through intermediate mediums. For the person of ordinary skill in the art, the specific meanings in the present application of the terms above can be understood according to the specific situations.

Referring to FIG. 1, the traction machine 01 of the present embodiment includes traction pulleys **1*c*, traction ropes 07 driven by the traction pulleys 1*c* and fixed pulleys for changing directions of the traction ropes 07. The fixed pulleys include first fixed pulleys 1*e* and second fixed pulleys 1*f*. The first fixed pulley 1*e* is provided with a sensor sensing member 1*k* rotating with the first fixed pulley 1*e*, a traction machine sensor 1*h* is arranged beside the first fixed pulley 1*e*; the traction machine sensor 1*h* is configured to detect the rotation speed of the sensor sensing member 1*k*, and send the rotation speed to a controller 03 of the traction machine 01. The controller 03 controls the rotation of the traction pulley 1*c* according to the detected data of the traction machine sensor 1*h***.

Since the traction machine 01 of the present application is provided with the sensor sensing member **1*k* and the traction machine sensor 1*h*, it is capable of detecting whether the traction machine 01 has an abnormal operation, and stopping the traction machine 01** in an abnormal state.

According to one of the embodiments of the present application, when the traction pulley **1*c* drives the traction rope 07 to move, the traction rope 07 simultaneously drives the fixed pulleys to rotate, and the sensor sensing member 1*k* rotates with the first fixed pulley 1*e*. Each time the sensor sensing member 1*k* rotates with the fixed pulleys, the traction machine sensor 1*h* contacts it once, and sends a signal to the controller 03 of the traction machine 01, so that the controller 03 determines the rotation speed of the fixed pulleys and compares it with the rotation speed of the traction pulley 1*c*, thereby determining whether the movement speed of the traction rope 07 meets the setting requirements. When an abnormal operation occurs, the controller 03 of the traction machine 01 stops the operation of the traction machine 01**.

According to one of the embodiments of the present application, the controller 03 of the traction machine 01 is connected to the bus of the controller 03, and the bus of the controller 03 is provided with a resistance module **1*i***.

The function of the resistance module **1*i* of the traction machine 01 is illustrated by taking a lifting equipment provided with this kind of traction machine 01** as an example:

When the lifting vehicle of the lifting equipment is descending, the controller 03 of the traction machine 01 drives the traction pulley **1*c* of the traction machine 01 to descend with the potential energy load, and the motor 1*a* of the traction machine 01 is in a regenerating braking state (power generation state). The regenerated electric energy is rectified by the controller 03 of the traction machine 01 and fed back to the bus of the controller 03. The voltage of the bus of the controller 03 continues to rise with the descending of the lifting vehicle, thereby adversely affecting or damaging the controller 03. In the present embodiment, when the bus voltage of the controller 03 of the traction machine 01 increases, since the bus of the controller 03 is connected with the resistance module 1*i*, the resistance module 1*i* will automatically generate heat and convert the additional electric energy into the heat energy of the resistance module 1*i* to consume, so that the bus voltage of the controller 03 of the traction machine 01** is maintained within a safe range.

According to one of the embodiments of the present application, the traction machine 01 includes a motor **1*a* and a speed reducer 1*b*. The motor 1*a* and the speed reducer 1*b* can be fixedly mounted by bolts. The speed reducer 1*b* and a machine fixing frame 1*g* can be bolted together. The traction pulleys 1*c* can be mounted to output shafts on both sides of the speed reducer 1*b* by bolts and gaskets. Pressing pulleys 1*d* can be fixed to both sides of the speed reducer 1*b* by bolts. Below the traction pulley 1*c*, the pressing pulley 1*d* presses the traction rope 07 into a pulley groove of the traction pulley 1*c*, so as to avoid the sliding between the traction rope 07 and the traction pulley 1*c*. The sensor sensing member 1*k* is mounted on the first fixed pulley 1*e***.

In FIG. 1, the fixed pulleys include the first fixed pulley 1*e* and the second fixed pulley 1*f*. Of course, the number and arrangement of the fixed pulley are not limited by the examples herein. Wherein, the first fixed pulleys 1*e* are mounted to upper portions of both sides of the machine fixing frame 1*g* (in FIG. 1, only one side of the machine fixing frame 1*g* can be seen, and the other side of the machine fixing frame 1*g* is also mounted with a fixed pulley). The traction machine sensor 1*h* is mounted on the machine fixing frame 1*g* at a position corresponding to the sensor sensing member 1*k*. The "corresponding" herein takes that the rotation speed change of the sensor sensing member 1*k* can be detected as a standard. The numbers and arrangements of the traction machine sensor 1*h* and the sensor sensing member 1*k* are not limited by the examples herein. The first fixed pulley 1*e* rotates to drive the sensor sensing member 1*k* to rotate to trigger the traction machine sensor 1*h*, so as to detect whether the traction rope 07 is slipping or whether the operating speed is normal through the controller 03. The second fixed pulleys 1*f* are mounted to lower portions of both sides of the machine fixing frame 1*g* and function as steering the traction rope 07. The resistance module 1*i* is mounted into the machine fixing frame 1*g*. Finally, a machine shield 1*j* is mounted on the machine fixing frame 1*g* to enclose the first fixed pulleys 1*e*, the second fixed pulleys 1*f*, the traction pulleys 1*c* and the pressing pulleys 1*d* within the machine shield 1. The machine shield 1*j* plays a protective role to prevent safety hazards when the traction machine 01 is operating.

Figure 2:
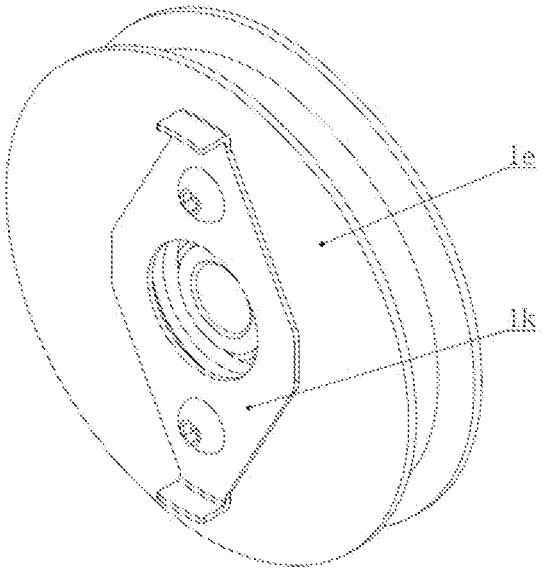
FIG. 2 is a mounting diagram of the sensor sensing member on the traction pulley according to an embodiment.

One of the structures of the sensor sensing member 1*k* is shown in FIG. 2. Of course, the sensor sensing member 1*k* in FIG. 2 does not constitute a limitation to the present application.

In addition, the present embodiment also provides a lifting equipment, including the traction machine 01 above. In addition, the lifting equipment of the present embodiment further includes a climbing member, a guide rail and a lifting vehicle. The guide rail is arranged on the climbing member.

According to one of the embodiments of the present application, the traction machine 01 is fixed to the guide rail by bolts penetrating through mounting holes of the guide rail. The form of the mounting hole is not limited, and for example, rectangular holes may be employed. The mounting position of the traction machine 01 can be adjusted as needed along a vertical direction of the guide rail. The traction machine 01 drives the traction pulleys 1*c* to rotate by the motor 1*a* and the speed reducer 1*b*, thereby driving the traction ropes 07 to move up and down, so as to achieve the ascending and descending of the lifting vehicle.

Wherein, the guide rail has rectangular holes or waist-round holes on a fixed plane. The rectangular holes or the waist-round holes are arranged at equal intervals along the length direction of the guide rail. The guide rail is mounted at the place where the lifting equipment operates, such as a climbing member in a fan tower, an electric power tower, a chimney and other buildings. The guide rail is fixed to the climbing member, the electric power tower, the chimney and other buildings above by bolts penetrating through the rectangular holes or waist-round holes of the guide rail. Wherein the fixed plane of the guide rail has protrusions, and the shape of the protrusion may be a triangle, a trapezoid, a rectangle or a circular arc, etc. The protrusions are arranged for increasing the fixing strength of the guide rail when the guide rail is fixed.

The guide rail is provided with a closing groove extending along the longitudinal direction of the guide rail, and an anti-falling device 2*h* capable of ascending and descending along the guide rail is mounted on the lifting vehicle.

Figure 3:
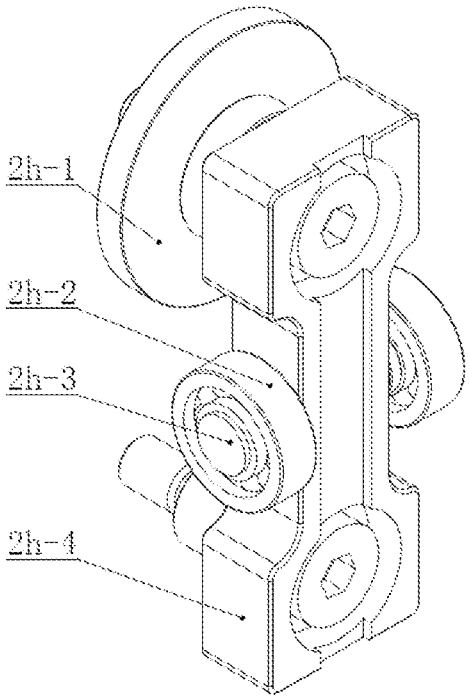
FIG. 3 is a perspective structural diagram of the anti-falling device according to an embodiment.
Figure 4:
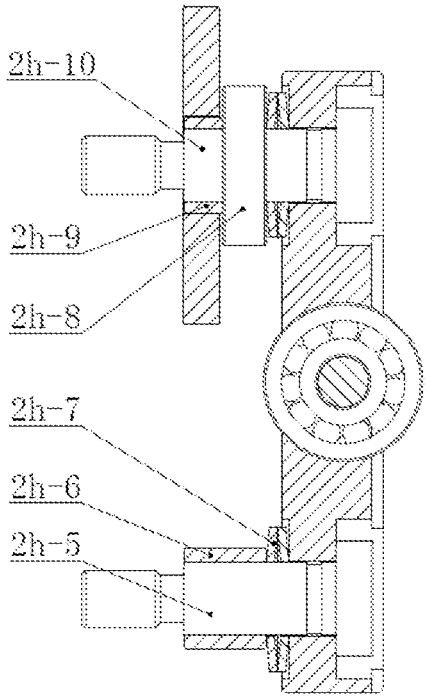
FIG. 4 is a sectional structural view of the anti-falling device according to an embodiment.

According to one of the embodiments of the present application, the structure of the anti-falling device 2*h* is shown in FIG. 3 and FIG. 4. In FIG. 3 and FIG. 4, the anti-falling device 2*h* includes an anti-falling main body 2*h*-4 embedded in the closing groove. The anti-falling main body 2*h*-4 is provided with first rollers 2*h*-2 in the closing groove and capable of sliding along the inner wall of the closing groove. The anti-falling device 2*h* also includes a second roller 2*h*-8 arranged at the opening of the closing groove and capable of sliding along the opening. It is apparent that the numbers and distributions of the first roller 2*h*-2 and the second roller 2*h*-8, and the structure of the anti-falling main body 2*h*-4 are not limited by the drawings.

Herein, the second roller 2*h*-8 slides along the opening, that is, the second roller 2*h*-8 slides along the side wall of the opening, therefore the side wall of the opening serves as guiding and limiting functions for the second roller 2*h*-8.

In one case, the number of the first rollers 2*h*-2 is at least two, and the first rollers 2*h*-2 are mounted on both sides of the anti-falling main body 2*h*-4 through a first roll shaft 2*h*-3. The second roller 2*h*-8 is mounted to the front surface of the anti-falling main body 2*h*-4 through the second roll shaft 2*h*-10, and the second roll shaft 2*h*-10 is perpendicular to the first roll shaft 2*h*-3. Wherein, the orientation of the anti-falling main body 2*h*-4 is determined based on the state in which the anti-falling main body 2*h*-4 is mounted to the lifting equipment.

In this case, by providing the first rollers 2*h*-2 and the second roller 2*h*-8, the lifting vehicle can ascend and descend along the guide rail. Meanwhile, since the first rollers 2*h*-2 are arranged in the closing groove, the lifting vehicle can be prevented from derailing.

Further, one side away from the closing groove of the second roller 2*h*-8 is provided with a wear plate 2*h*-1. Therefore, by the cooperation of the wear plate 2*h*-1 and the second roller 2*h*-8, the operation stability of the lifting vehicle along the guide rail can be further ensured so as to prevent the lifting vehicle from derailing.

In FIG. 3 and FIG. 4, the second roll shaft 2*h*-10 may be fixed to the lifting vehicle by a bolt sequentially penetrating through the anti-falling main body 2*h*-4, the second roller 2*h*-8 and the wear plate 2*h*-1. Further, in order to prevent the direct contact between the wear plate 2*h*-1 and the guide rail, and to protect the lifting vehicle, the wear plate 2*h*-1 is mounted to the second roll shaft 2*h*-10 through a first positioning sleeve 2*h*-9, thereby leaving a certain gap between the lifting vehicle and the wear plate 2*h*-1, and a certain gap between the wear plate 2*h*-1 and the second roller 2*h*-8. The wear plate 2*h*-1 may have a round shape, and the diameter of the wear plate 2*h*-1 is greater than the width of the opening, so that the wear plate 2*h*-1 and the first roller 2*h*-2 are respectively located inside and outside the closing groove. And the second roller 2*h*-8 is limited at the opening by the wear plate 2*h*-1 and the first rollers 2*h*-2.

In addition, a first elastic member capable of extending and retracting along the second roll shaft 2*h*-10 direction is arranged between the second roller 2*h*-8 and the anti-falling main body 2*h*-4. By the arrangement of the first elastic member, the problem of the stuck operation of the lifting vehicle caused by the misalignment of the guide rail can be avoided. The first elastic member herein can be a disc spring, and the number of the disc spring may be plural. For example, two disc springs may be arranged between the second roller 2*h*-8 and the anti-falling main body 2*h*-4.

The second roller **2*h*-8 of the present embodiment may be plural and distributed up and down along the height direction of the anti-falling main body 2*h*-4. Of course, as shown in FIG. 3 and FIG. 4, the second roller 2*h*-8 may also be connected to the upper portion of the anti-falling main body 2*h*-4, and the lower portion of the anti-falling main body 2*h*-4 may be provided with a second positioning sleeve 2*h*-6. The second positioning sleeve 2*h*-6 is mounted to the front surface of the anti-falling main body 2*h*-4 through a third roll shaft 2*h*-5 which is parallel to the second roll shaft 2*h*-10. Wherein, the lifting vehicle can be prevented from directly contacting the guide rail by providing the second positioning sleeve 2*h*-6**, thereby maintaining the stable structural relation between the lifting vehicle and the guide rail.

Similarly, in order to prevent the lifting vehicle from being stuck, a second elastic member **2*h*-7 capable of extending and retracting along the length direction of the third roll shaft 2*h*-5 is arranged between the second positioning sleeve 2*h*-6 and the anti-falling main body 2*h*-4. The structure and form of the second elastic member 2*h*-7 is also not limited. The third roll shaft 2*h*-5 herein may also be a bolt, so that the anti-falling device 2*h* can be fixed to the lifting vehicle by the bolt penetrating through the anti-falling main body 2*h*-4 and the second positioning sleeve 2*h*-6** sequentially.

The specific forms of the first rollers **2*h*-2 and the second roller 2*h*-8 are not limited. For example, they may be both in the form of bearings, or ordinary runners, as long as the anti-falling device 2*h*** can be rolled along the guide rail.

According to one of the embodiments of the present application, the lifting equipment further includes a stall braking device. Specifically, the vehicle body of the lifting vehicle is equipped with the stall braking device, and in the case of stall or the traction rope 07 being broken, the lifting vehicle is quickly locked on the guide rail, thereby achieving the operation stop of the lifting vehicle which will not fall. The stall braking device includes a speed-limiting assembly 4 and a safety protection assembly **2*i***.

Figure 5:
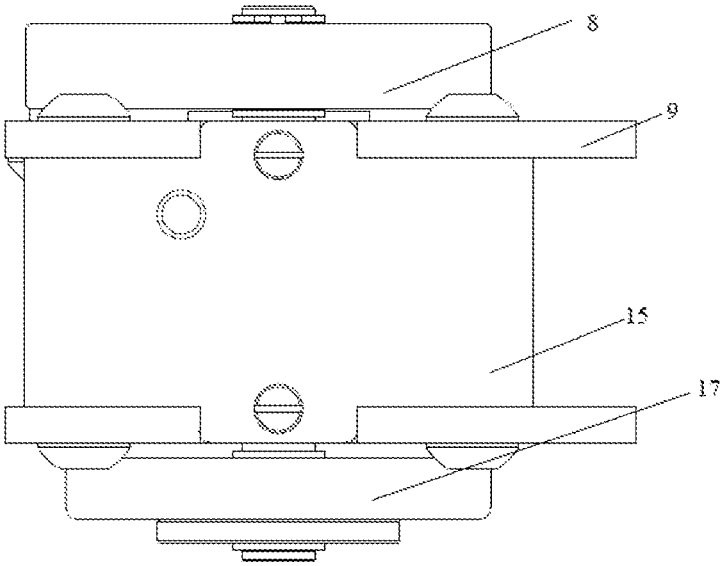
FIG. 5 is a top structural view of the speed-limiting assembly according to an embodiment.
Figure 6:
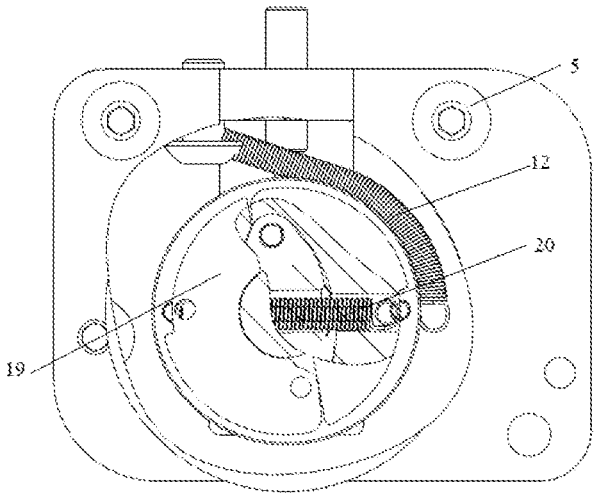
FIG. 6 is a side structural view of the speed-limiting assembly according to an embodiment.

According to one of the embodiments of the present application, as shown in FIG. 5 and FIG. 6, the speed-limiting assembly 4 of the present embodiment includes a speed measuring wheel 17, a centrifugal block 19 and a braking cam 8. Wherein, the centrifugal block 19 is fixed to the speed measuring wheel 17 and rotates with the speed measuring wheel 17, and the centrifugal block 19 satisfies: when the speed of the speed measuring wheel 17 is not less than a set speed, the centrifugal block 19 opens and connects the braking cam 8 so as to drive the braking cam 8 to rotate.

Herein, the connection between the centrifugal block 19 and the braking cam 8 may be either a direct connection or an indirect connection.

The speed-limiting assembly 4 of the present embodiment is fixed to the lifting vehicle 1, and when the speed-limiting assembly 4 is mounted on the guide rail 3, the speed measuring wheel 17 can measure and obtain the lifting speed of the lifting vehicle 1. Once the rotation speed of the speed measuring wheel 17 is not less than the set speed, it indicates that the lifting speed of the lifting vehicle 1 exceeds the safety limit. At this time, the centrifugal block 19 opens to drive the braking cam 8 to rotate, so as to achieve the direct speed limit or braking for the lifting vehicle 1. The speed-limiting assembly 4 can avoid the hazard caused by the connection failure between the lifting vehicle 1 and the traction rope 07, and the risk of the tilting of the lifting vehicle 1.

Figure 7:
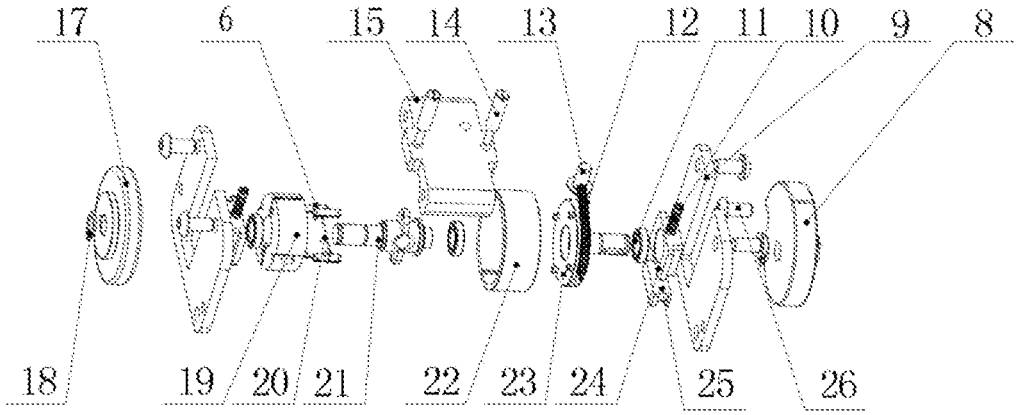
FIG. 7 is an exploded structural view of the speed-limiting assembly according to an embodiment.

As shown in FIG. 7, in the speed-limiting assembly 4 of the present embodiment, the speed measuring wheel 17 and the centrifugal block 19 are fixedly mounted on a main shaft 21, and the speed measuring wheel 17 drives the centrifugal block 19 to rotate through the main shaft 21. Of course, in addition to that the centrifugal block 19 is fixed to the speed measuring wheel 17 by the main shaft 21, the centrifugal block 19 can be directly connected to the speed measuring wheel 17 by a centrifugal spring 20, or can be connected to the speed measuring wheel 17 by any means disclosed in the prior art.

In addition, the braking cam 8 is fixedly mounted on a transmission shaft, and the centrifugal block 19 is connected to the transmission shaft through a transmission sleeve 22 when opened. Therefore, when the rotation speed of the speed measuring wheel 17 is not less than the set speed, the centrifugal block 19 can drive the transmission shaft to rotate through the transmission sleeve 22, thereby driving the braking cam 8 to perform braking.

Of course, the connection between the centrifugal block 19 and the transmission shaft is not necessary through the transmission sleeve 22. Any connection that allows the transmission between the centrifugal block 19 and the transmission shaft can be applied between the centrifugal block 19 and the transmission shaft.

And the braking cam 8 does not have to be connected to the transmission shaft. For example, the centrifugal block 19 can also be directly connected to the braking cam 8, that is, when the centrifugal block 19 opens, it directly contacts the braking cam 8 and drives the braking cam 8 to rotate.

Figure 8:
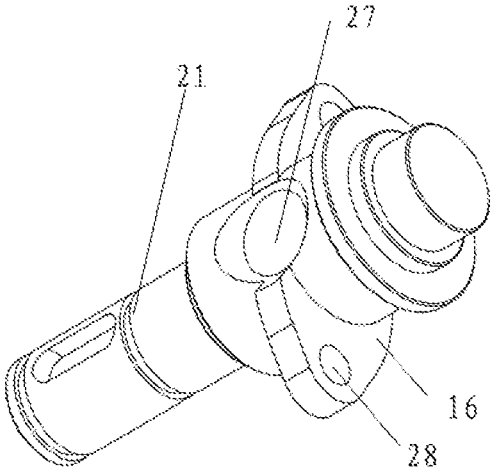
FIG. 8 is a perspective structural diagram of the main shaft according to an embodiment.
Figure 9:
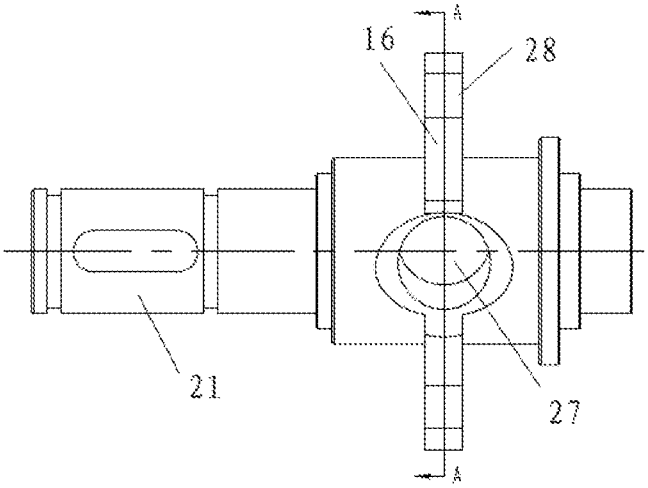
FIG. 9 is a side structural view of the main shaft according to an embodiment.
Figure 10:
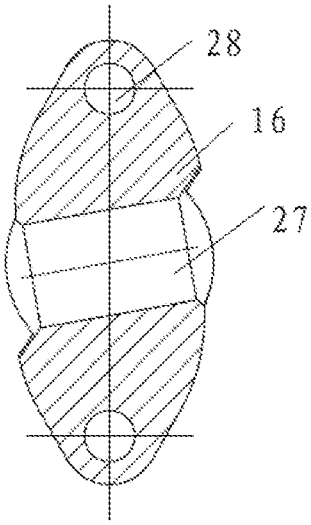
FIG. 10 is a sectional structural view of A-A in FIG. 9.

As shown in FIG. 8 to FIG. 10, the main shaft 21 of the present embodiment is provided with a first through hole 27 in a radial direction. After the centrifugal spring 20 passes through the first through hole 27, each of the two ends of the centrifugal spring 20 is fixed with a centrifugal block 19, respectively. In this case, when the rotation speed of the main shaft 21 is in a safe range, the two centrifugal blocks 19 tightly hold the main shaft 21 under the action of the centrifugal spring 20. Once the rotation speed of the main shaft 21 exceeds the safe range, the two centrifugal blocks 19 are opened by the centrifugal force. Wherein, the centrifugal block 19 can, but do not have to, be fixed to the centrifugal spring 20 by a pin shaft. Since two centrifugal blocks 19 are connected by one centrifugal spring 20, it not only simplifies the structure, but also ensures that the main shaft 21 is balanced by force so as to prevent the main shaft 21 from being eccentric.

Referring further to FIG. 8, lugs 16 can be formed on the main shaft 21, and the lug 16 is provided with a second through hole 28 extending axially along the main shaft 21. When the centrifugal block 19 is connected to the centrifugal spring 20 by the pin shaft, it can be further hinged to the lug 16 through the pin shaft. For example, a clearance fit can be used between the pin shaft and the second through hole 28, so that the centrifugal block 19 can rotate around the second through hole 28 with the pin shaft as a rotating shaft. The pin shaft herein can be an elastic cylindrical pin 6.

In this case, different centrifugal blocks 19 are all rotated relative to the second through holes 28 on the main shaft 21, and open as the centrifugal blocks 19 rotate. Since the centrifugal block 19 is not wholly away from the main shaft 21 by centrifugation, but one end is hinged to the lug 16 on the main shaft 21 and the other end is rotated by the centrifugal force, this kind of centrifugal block 19 can achieve a more precise control. In addition, since the connecting line of the two second through holes 28 on the lugs 16 radially coincides with the main shaft 21, the two centrifugal blocks 19 which rotate around the second through holes 28 will not generate an eccentric force to the main shaft 21.

It can be seen from FIG. 10 that, the angle between the first through hole 27 and the connecting line of the two second through holes 28 is less than 90°, therefore the rotation radius of the centrifugal block 19 rotating around the second through hole 28 can be reduced.

In addition, when the centrifugal block 19 drives the braking cam 8 to rotate through the transmission sleeve 22, a first circumferential limiting member may be formed on the outer surface of the centrifugal block 19, and a second circumferential limiting member is formed on the inner surface of the transmission sleeve 22. Therefore, when the centrifugal block 19 opens, the first circumferential limiting member and the second circumferential limiting member are circumferentially locked, so that the centrifugal block 19 can drive the transmission sleeve 22 to rotate, thereby driving the braking cam 8 to perform braking. Of course, in addition to that the transmission between the centrifugal block 19 and the transmission sleeve 22 is achieved by the limiting members (that is, the first circumferential limiting member and the second circumferential limiting member), the transmission can also be achieved by friction fit or any means disclosed in the prior art.

Figure 11:
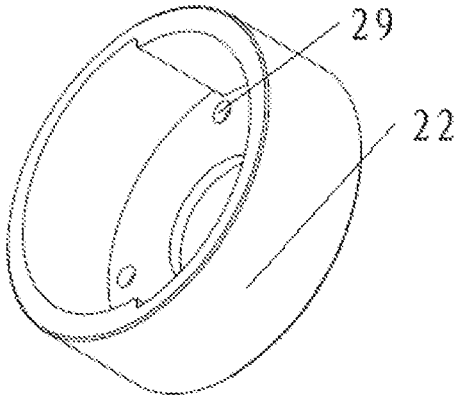
FIG. 11 is a perspective structural diagram of the transmission sleeve according to an embodiment.
Figure 12:
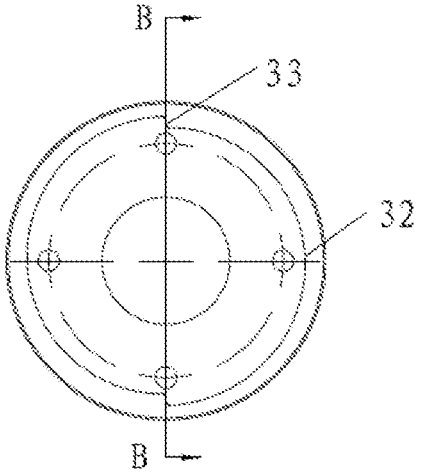
FIG. 12 is a side structural view of the transmission sleeve according to an embodiment.
Figure 13:
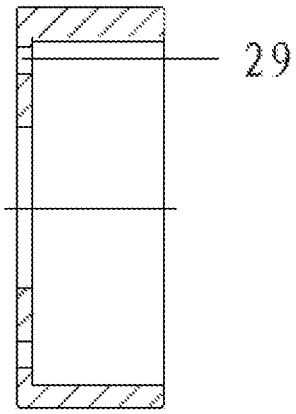
FIG. 13 is a sectional structural view of B-B in FIG. 12.
Figure 14:
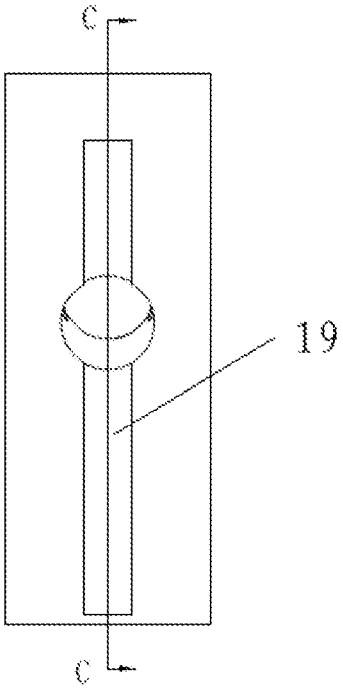
FIG. 14 is a side structural view of the centrifugal block according to an embodiment.
Figure 15:
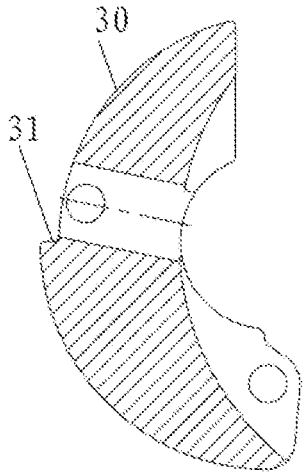
FIG. 15 is a sectional structural view of C-C in FIG. 14.

The structure of the transmission sleeve 22 of the present embodiment is shown in FIG. 11 to FIG. 13. The outer surface of the centrifugal block 19 includes two first involute surfaces 30, and the first circumferential limiting member is formed between the first involute surfaces 30. The structure of the centrifugal block 19 of the present embodiment is shown in FIG. 14 and FIG. 15. The inner surface of the transmission sleeve 22 includes two second involute surfaces 32, and the second circumferential limiting member is formed between the second involute surfaces 32. The fitting surface between the centrifugal block 19 and the transmission sleeve 22 uses the involute surface design, so that an effective fit between the centrifugal block 19 and the transmission sleeve 22 is ensured, which is advantageous for achieving the circumferential locking between the first circumferential limiting member and the second circumferential limiting member when the centrifugal block 19 rotates, preventing the ineffective interference between the centrifugal block 19 and the transmission sleeve 22.

Wherein, it is preferable but not necessary that: the first circumferential limiting member is a first limiting stair 31, and the second circumferential limiting member is a second limiting stair 33. Such limiting fit is simple and reliable.

In addition, in FIG. 7, the transmission shaft is a cam half shaft 23, so that the centrifugal block 19 needs to drive the cam half shaft 23 to rotate through the transmission shaft 22. The end of the cam half shaft 23 extends out toward the transmission sleeve 22 with connecting pins, and the transmission sleeve 22 is provided with pin holes 29, so that the connecting pins extend into the pin holes 29 of the transmission sleeve 22. In order to ensure the stress is balanced, a plurality of connecting pins, for example four connecting pins, are evenly distributed at the end of the transmission shaft. Of course, the connection manner between the cam half shaft 23 and the transmission sleeve 22 is not limited by the example herein, as long as the transmission sleeve 22 can drive the cam half shaft 23 to rotate.

Figure 16:
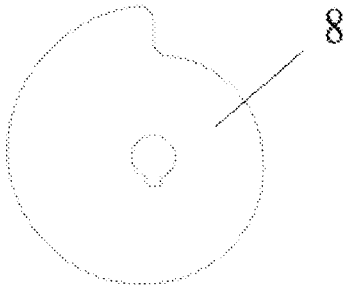
FIG. 16 is a structural diagram of the braking cam according to an embodiment.

As shown in FIG. 16, the braking cam 8 includes four third involute surfaces that are smoothly butted, so as to achieve the gradual increase in the braking pressure of the brake cam 8. In this case, the braking cam 8 is easy to manufacture and can adjust the pressing degree during the pressing process.

Referring further to FIG. 5 to FIG. 7, the speed-limiting assembly 4 of the present embodiment also includes fixed baffles and a bearing housing 24. Wherein, the fixed baffles include two supporting side plates 9 parallel to each other, and a top plate 15 for connecting the two supporting side plates 9; the bearing housing 24 is mounted between the supporting side plates 9 and the top plate 15, including a first bearing housing 24 and a second bearing housing 24. The first bearing housing 24 is configured to fix a bearing 11 of the main shaft 21, the second bearing housing 24 is configured to fix a bearing 11 of the transmission shaft. The speed measuring wheel 17 and the braking cam 8 are respectively located on the outer sides of the two supporting side plates 9.

Wherein, the two supporting side plates 9, as well as the top plate 15 and the supporting side plates 9 are fixedly connected through fasteners 5. Herein, the fastener 5 may be a bolt. As another example, the fastener 5 may be used to mount the speed-limiting assembly 4 of the present embodiment on the lifting equipment mentioned below.

In addition, in order to limit the rotation angle of the braking cam 8, the limiting assembly further includes a limiting bolt 26 that can cooperate with the braking cam 8 and prevent the further rotation of the braking cam 8.

In this case, the fixed baffles can not only isolate and protect the transmission members (including the main shaft 21, the transmission shaft, the centrifugal block 19 and the transmission sleeve 22, etc.) on the inner side thereof, but also fix the main shaft 21 and the transmission shaft by mounting the bearing housing 24.

In addition, in order to achieve a reliable mounting of the speed measuring wheel 17, the speed measuring wheel 17 is connected to the main shaft 21 via a shaft elastic check ring 18. That is, the shaft elastic check ring 18 is provided on the outer side of the speed measuring wheel 17, and the shaft elastic check ring 18 is clamped on the main shaft 21.

Wherein, it can be seen from FIG. 6 and FIG. 7 that, the transmission shaft and the top plate 15 are connected through a return spring 12. Therefore, an automatic restoration of the braking cam 8 can be achieved by the return spring 12. Wherein, a first end of the return spring 12 can be fixed to the top plate 15 by a fixing bolt 13, and a second end of the return spring 12 can be directly fixed to the outer peripheral surface of the cam half shaft 23.

The bottom end of the bearing housing 24 is mounted on the supporting side plate 9 through a spacer 25 so as to ensure the mounting reliability of the bearing housing 24.

The top end of the bearing housing 24 is elastically connected to the top plate 15 by an elastic member. In this case, the mounting position of the bearing housing 24 can be adjusted through the elastic member so as to achieve the position adjustment of the speed measuring wheel 17. For example, when the speed-limiting assembly 4 is mounted between the guide rail 3 and the lifting vehicle 1 of the lifting equipment, the speed measuring wheel 17 is always reliably moving along the guide rail 3 by adjusting the position of the bearing housing 24.

Wherein, a compression spring 10 can be connected to the top end of the bearing housing 24, and an adjusting bolt 14 extending toward the compression spring 10 is fixed to the top plate 15, and the adjusting bolt 14 at least partially extends into the compression spring 10. The compression spring 10 and the adjusting bolt 14 herein constitute the elastic member between the bearing housing 24 and the top plate 15 above. The compression spring 10 can be compressed or released by the adjusting bolt 14, thereby adjusting the position of the bearing housing 24.

Figure 17:
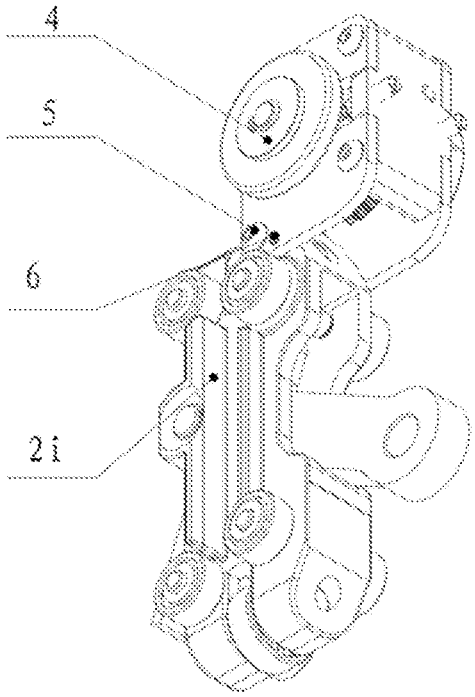
FIG. 17 is a structural diagram of the stall braking device according to an embodiment.
Figure 18:
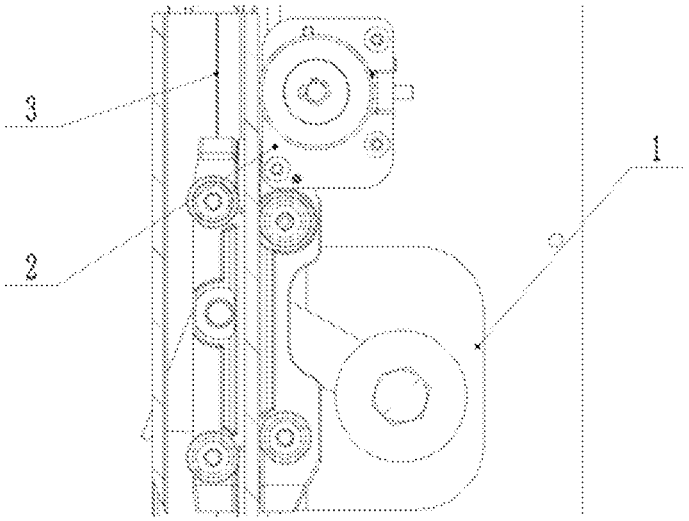
FIG. 18 is a partial structural diagram of the lifting equipment according to an embodiment.

The stall braking device 2 of the present embodiment is shown in FIG. 17. The mounting of the stall braking device 2 is shown in FIG. 18. The mounting of the speed-limiting assembly 4 satisfies: the speed measuring wheel 17 rolls along the guide rail 3, and when the centrifugal block 19 opens, the braking cam 8 rotates and press the guide rail 3.

Since the stall braking device 2 is directly mounted on the lifting vehicle 1 so that the lifting vehicle 1 is immediately stopped running when it exceeds the safe speed, the lifting equipment of the present embodiment is safe and reliable, and can reduce the risk when the stalling control is performed by the traction rope 07, and does not face the danger of tilting when the lifting vehicle 1 is locked, and reduces the impact and damage to the lifting equipment.

In addition, the stall braking device 2 further includes a safety protection assembly 2*i* fixed to the speed-limiting assembly 4. Therefore, the safety protection assembly 2*i* can prevent the lifting vehicle 1 from suddenly descending and falling along the guide rail 3.

It can be seen from FIG. 18 that, the supporting side plate 9 of the speed-limiting assembly 4 is connected to the safety protection assembly 2*i* by a pin shaft. Similarly, the pin shaft herein can be an elastic cylindrical pin 6.

Figure 19:
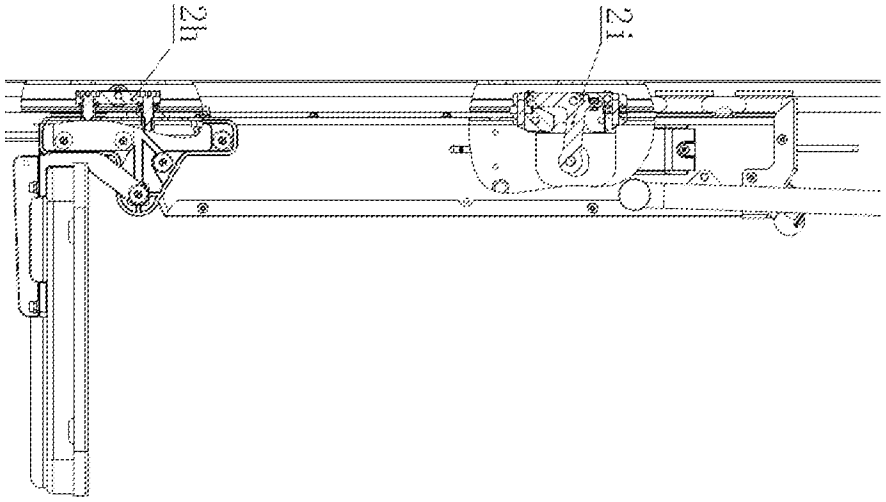
FIG. 19 is a mounting diagram (I) of the safety protection assembly according to an embodiment.
Figure 20:
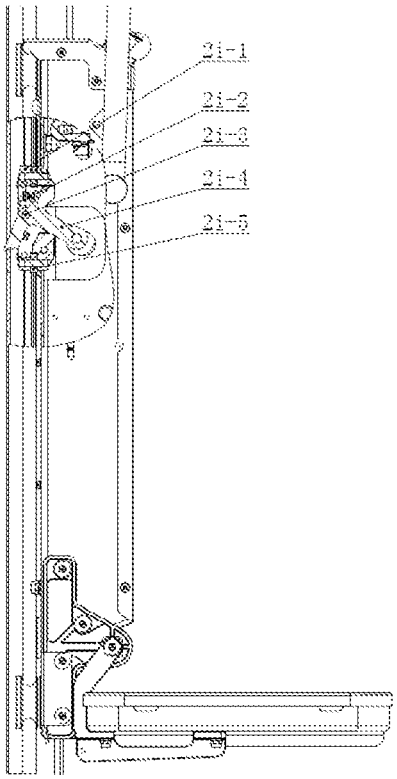
FIG. 20 is a mounting diagram (II) of the safety protection assembly according to an embodiment.

As shown in FIG. 19 and FIG. 20, the safety protection assembly 2*i* of the present embodiment includes a locking block 2*i*-4 hinged on the lifting vehicle. When the lifting vehicle operates normally, the locking block 2*i*-4 compresses a spring, and when the lifting vehicle stalls, the spring ejects the locking block 2*i*-4 so that the locking block 2*i*-4 is embedded in a locking hole of the guide rail.

According to one of the embodiments of the present application, the locking block 2*i*-4 is mounted to a safety protection main body 2*i*-1 through the safety protection assembly with a rotation shaft 2*i*-3. One end of the safety protection assembly spring 2*i*-2 is mounted to the safety protection main body 2*i*-1, the other end is mounted to the locking block 2*i*-4 so as to generate a certain elastic force to the locking block 2*i*-4. The safety protection assembly is mounted to the safety protection main body 2*i*-1 with a roller 2*i*-5 so as to ensure that the safety protection assembly 2*i* can smoothly slide in the guide rail.

According to one of the embodiments of the present application, the safety protection assembly 2*i* can be mounted on a lifting vehicle support by a bolt penetrating through a round hole of the locking block 2*i*-4. The waist-shaped hole on the lifting vehicle support ensures that the safety protection assembly 2*i* can move relative to the lifting vehicle within a certain range. When the lifting vehicle is operating, under the weight of the safety protection main body 2*i*-1 and the action of the lifting vehicle support, the bolted end of the locking block 2*i*-4 is lifted relative to the safety protection main body 2*i*-1, and the other end of the locking block 2*i*-4 is substantially flush with the safety protection main body 2*i*-1 and presses the spring, so that the safety protection assembly 2*i* moves uniformly with the lifting vehicle in the guide rail, as shown in FIG. 19. When the traction rope 07 breaks and the lifting vehicle falls, the safety protection assembly 2*i* is moving with the lifting vehicle, and the supporting force of the lifting vehicle support for the locking block 2*i*-4 disappears, the locking block 2*i*-4 of the safety protection assembly 2*i* is ejected and locked in a locking hole of the guide rail due to the elastic force of the spring, as shown in FIG. 20, so that the locking of the lifting vehicle when it is falling is achieved, and the safety of life and property of the equipment and personnel are ensured.

According to one of the embodiments of the present application, the lifting equipment is further provided with a manual braking device 2*j*. The manual braking device 2*j* is mounted on the upper portion of the lifting vehicle, and one end of the manual braking device 2*j* is connected to the safety protection assembly 2*i*. When the equipment is falling and not locked, the safety protection assembly 2*i* can be forced to be locked in the locking holes of the guide rail by pulling the manual braking device 2*j*, so as to ensure the safety of operating personnel. Wherein, the locking hole can be a rectangular hole.

Figure 21:
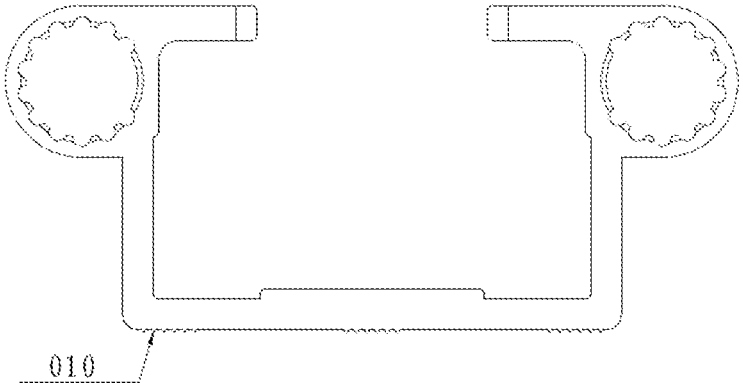
FIG. 21 is a top structural view of the guide rail according to an embodiment.
Figure 22:
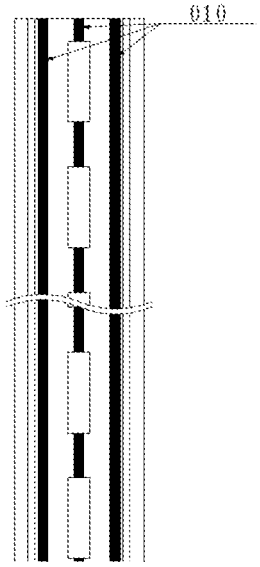
FIG. 22 is a side structural view of the guide rail according to an embodiment.

The structure of the guide rail of the present embodiment is shown in FIG. 21 and FIG. 22. The side facing the climbing member of the guide rail is provided with friction protrusions 010, which can be selected as triangular protrusions, thereby ensuring the mounting reliability of the guide rail on the climbing member.

Figure 28:
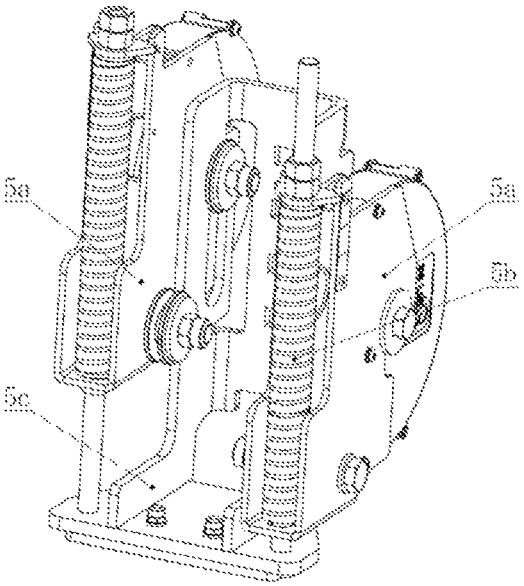
FIG. 28 is a structural diagram of the tensioning device according to an embodiment.

According to one of the embodiments of the present application, the top portion of the guide rail is mounted with guiding pulleys for the traction rope 07, and the bottom portion of the guide rail is provided with a tensioning device for the traction rope 07. The structure of the tensioning device is shown in FIG. 28. Tensioning pulleys are provided in the tensioning device.

The guiding pulleys and the tensioning pulleys are fixed at the top portion and bottom portion of the guide rail respectively. There are two guiding pulleys and two tensioning pulleys respectively, each of the left side and right side of the guide rail is provided with a guiding pulley and a tensioning pulley. Wherein, the tensioning pulleys at the bottom portion can move along the guide rail within a certain range, and the tensioning device is further provided with a tensioning spring 5*b* and a guiding support 5*c*. A tensioning support 5*a* can move relative to the guiding support 5*c*, so as to drive the tensioning pulley to move up and down to adjust the tensioning force of the traction rope 07.

Due to the different site environments, the guide rail will have different degrees of inclination after mounting, and because the position of the traction rope 07 is determined by the guiding pulleys and the tensioning pulleys, the traction rope 07 may have frictions and scratches with the climbing member etc., mounted on the chimney, tall building, tower silo, ropeway pole, transmitting antenna, wind power generator, high-voltage tower and crane or the similar objects on site, affecting the life of the traction rope 07. At the same time, the traction rope 07 will cause damages to the climbing member etc., mounted on the chimney, tall building, tower silo, ropeway pole, transmitting antenna, wind power generator, high-voltage tower and crane or the similar objects on site. In order to solve the problem, traction rope protection assemblies 09 are fixed on the guide rail of the lifting equipment for holding up the traction rope 07, so as to avoid the frictions and scratches on the climbing member etc., mounted on the chimney, tall building, tower silo, ropeway pole, transmitting antenna, wind power generator, high-voltage tower and crane or the similar objects. In one of the cases, the climbing member is a ladder.

In addition, the types of the lifting equipment include elevators, cranes, climbing-free devices, etc., and are not limited by the examples herein.

Figure 23:
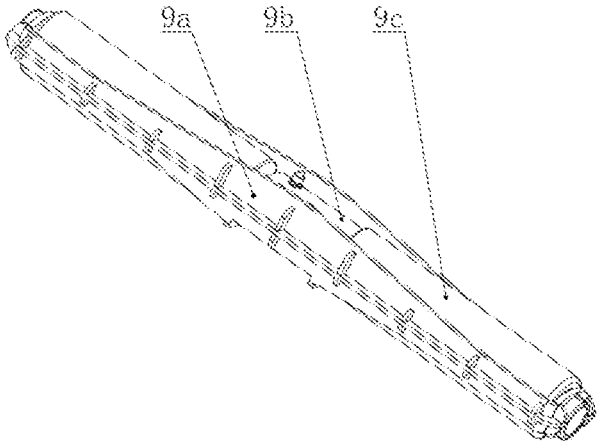
FIG. 23 is structural diagram of the traction rope protection assembly according to an embodiment.

As shown in FIG. 23, the traction rope protection assembly 09 includes idler rollers 9*c* and a mounting bracket 9*b* for mounting the idler rollers 9*c* to the climbing member. The rotation direction of the idler roller 9*c* is perpendicular to the lifting direction of the traction rope 07, and the idler rollers 9*c* are between the climbing member and the traction rope 07. Wherein, the idler rollers can rotate freely on the mounting bracket 9*b*. The number of the idler rollers 9*c* may be two or more, and the idler rollers 9*c* are symmetrically distributed on both sides of the guide rail to protect the traction ropes 07 on both sides of the guide rail.

Figure 24:
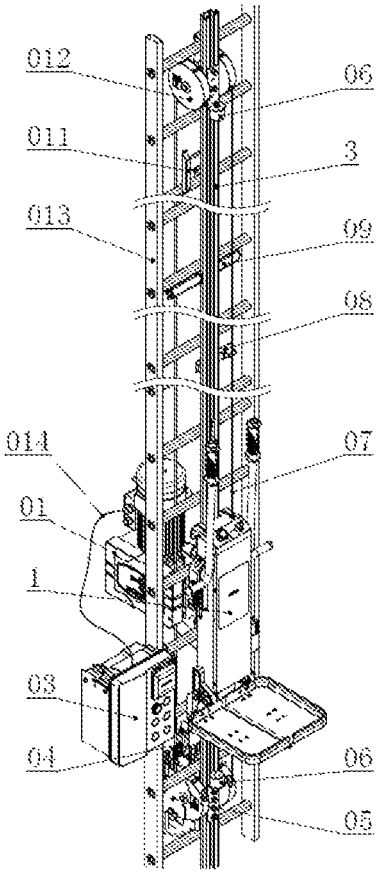
FIG. 24 is a structural diagram of the lifting equipment according to an embodiment.

Wherein, the traction rope protection assembly 09 may further include baffles 9*a* on both sides of the idler roller 9*c* and the mounting bracket 9*b* for protecting the idler roller 9*c* and the mounting bracket 9*b*. The mounting of the traction rope protection assembly 09 is shown in FIG. 24.

Referring to FIG. 24 again, according to one of the embodiments of the present application, buffering devices 06 are mounted on the top portion and the bottom portion of the guide rail respectively. The buffering device 06 may include a fixed plate and a buffering block mounted on the top portion and the bottom portion of the guide rail respectively for preventing the lifting vehicle from departing from the lifting vehicle, and buffering and the absorbing the energy when the lifting vehicle is suffering impacts.

Referring to FIG. 24 again, according to one of the embodiments of the present application, triggering blocks 08 are arranged on the corresponding climbing member or guide rail at the places where space changes. When the lifting vehicle runs to the triggering block 08, the triggering block 08 sends the current position information to the controller 03, and the controller 03 controls the operating speed of the lifting vehicle according to the position information.

In addition, a first fixed pulley assembly 05 and a second fixed pulley assembly 012 are provided on both ends of the guide rail respectively.

Figure 25:
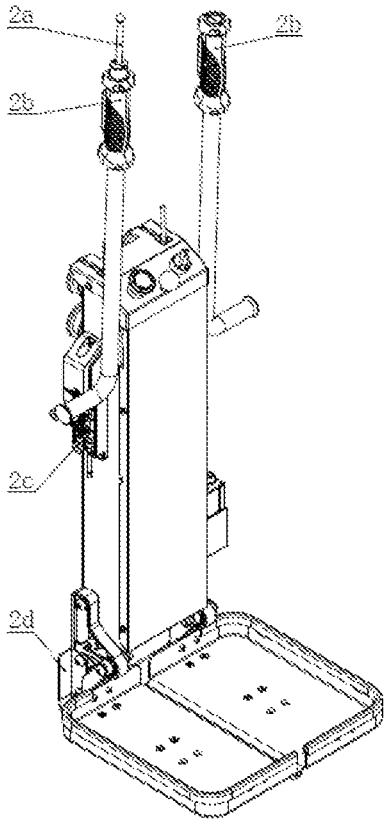
FIG. 25 is a structural diagram (I) of the lifting vehicle according to an embodiment.
Figure 26:
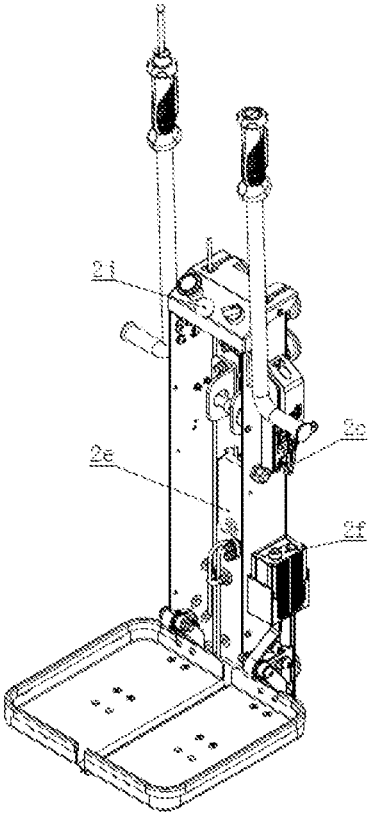
FIG. 26 is a structural diagram (II) of the lifting vehicle according to an embodiment.
Figure 27:
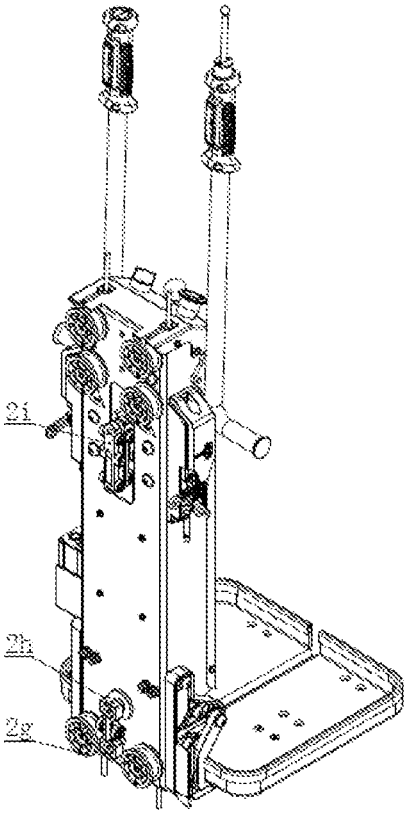
FIG. 27 is a structural diagram (III) of the lifting vehicle according to an embodiment.

The structure of the lifting vehicle is shown in FIG. 25 to FIG. 27.

According to one of the embodiments of the present application, a double-hand switch is provided on the lifting vehicle, and both hands are needed to simultaneously operate to start up the lifting equipment, thereby restraining the positions of the hands when the operator is operating the lifting vehicle, avoiding the accidental scratching to the operator due to the open running channel. Wherein, the double-hand switch is the form of the handle switches 2*b*.

Specifically, each of the two handles of the lifting vehicle is provided with a handle switch 2*b*. The operator needs to simultaneously hold the handle switches 2*b* to operate the equipment, restraining the operator operating the lifting vehicle with both hands on the lifting vehicle, so as to prevent the operator from operating the equipment with one hand and the other hand extending out of the lifting vehicle to cause accidental scratching.

According to one of the embodiments of the present application, the lifting equipment is provided with a platform anti-collision device 2*a*. The platform anti-collision device 2*a* is mounted on one of the two handle switches 2*b*. When the lifting vehicle runs upward and the platform anti-collision device 2*a* encounters an obstacle, the lifting equipment automatically stops so as to prevent the equipment from damage.

According to one of the embodiments of the present application, a limiting sensor 2*c* is provided on each of the left side and the right side of the lifting vehicle respectively. The limiting sensor 2*c* on the left side cooperates with a second limiting device 011 to achieve the upper limit function; the limiting sensor 2*c* on the right side cooperates with the triggering block 08 to achieve the position recognition function. Wherein the second limiting device 011 is mounted on the bottom portion of the guide rail to achieve the lower limit function. Wherein, since the bottom portion of the guide rail has electrical signals, there is no need to additionally provide a sensor matching with the second limiting device 011.

The first limiting device 04 and the second limiting device 011 are also respectively fixed on the top portion and the bottom portion of the guide rail, and the first limiting device 04 and the second limiting device 011 are higher than the tensioning pulleys at the bottom portion and lower than the guiding pulleys at the top portion. When the lifting vehicle runs to the limiting device (the first limiting device 04 or the second limiting device 011), the limiting switch will be triggered.

According to one of the embodiments of the present application, the lifting equipment is provided with a wireless transmitting device 2*e*. When the limiting switches above are triggered, the wireless transmitting device 2*c* transmits a signal to the controller 03, and the controller 03 stops the operation of the traction machine 01.

According to one of the embodiments of the present application, several sets of walking pulleys 2*g* are mounted on the upper portion and the lower portion of the back side of the lifting vehicle, and the arc concave surface of the walking pulley 2*g* holds the arc convex surfaces on both sides of the guide rail to ensure the movement of the lifting vehicle along the guide rail. The walking pulley 2*g* can be made of non-metallic material to avoid the wear on the guide rail by the long-term operation.

In addition, in the case that the lifting vehicle is provided with the wireless transmitting device 2*e*, the wireless transmitting device 2*e* collects various signals during the operation of the lifting vehicle, such as the signal of the handle switch 2*b*, the signal of the limiting sensor 2*c*, the signal of the platform anti-collision device 2*a*, the signal of the triggering block 08, etc., and the signals are transmitted to the controller 03 by the wireless transmitting device 2*e*, so that the controller 03 sends action commands to the traction machine 01 by determining the signals. The wireless transmitting device 2*e* can be mounted in the lifting vehicle.

The wireless transmitting device 2*e* of the lifting vehicle may include a warning module, so that when the lifting vehicle runs to the triggering block 08, the warning module automatically issues a warning sound to remind the operator of the position change of the lifting vehicle.

In addition, the lifting vehicle may also be provided with a battery 2*f* which can be mounted in a battery box on the side of the lifting vehicle, and the battery 2*f* can supply power to the wireless transmitting device 2*e*.

The embodiments above are only for illustrating the present application, and not intended to limit the present application. Although the present application has been described in detail with reference to the embodiments, the person of ordinary skill in the art should understand that, various combinations, modifications, and equivalent replacements of the technical solutions of the present application do not depart from the spirit and scope of the technical solutions of the present application, and should be encompassed within the scope of the claims of the present application.

The various embodiments described above can be combined to provide further embodiments. All of the U.S. patents, U.S. patent application publications, U.S. patent applications, foreign patents, foreign patent applications and non-patent publications referred to in this specification and/or listed in the Application Data Sheet are incorporated herein by reference, in their entirety. Aspects of the embodiments can be modified, if necessary to employ concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A lifting equipment, comprising:

a traction machine, a climbing member, a guide rail and a lifting vehicle, wherein the guide rail is arranged on the climbing member, wherein the traction machine comprises:

one or more traction pulleys;

first and second fixed pulleys for changing directions of one or more traction ropes;

the one or more traction ropes driven by the one or more traction pulleys and the first and second fixed pulleys, wherein the first fixed pulley is provided with a sensor sensing member rotating with the first fixed pulley;

a traction machine sensor arranged beside the first fixed pulley, the traction machine sensor configured to detect a rotation speed of the sensor sensing member, and send the detected rotation speed data to the traction machine;

a controller in the traction machine that receives the detected rotation speed data and controls a rotation of the one or more traction pulleys according to the detected rotation speed data of the traction machine sensor, wherein the controller and the traction machine sensor detect whether the one or more traction ropes are slipping or whether an operating speed is normal, and in response to detecting the traction machine has an abnormal operation, stop the abnormal operation of the traction machine;

wherein the guide rail is provided with a closing groove extending along a longitudinal direction of the guide rail, and an anti-falling device capable of ascending and descending along the guide rail is mounted on the lifting vehicle, the anti-falling device comprises an anti-falling main body embedded in the closing groove, the anti-falling main body is provided with first rollers in the closing groove and capable of sliding along an inner wall of the closing groove, wherein the anti-falling device further comprises a second roller arranged at an opening of the closing groove and capable of sliding along the opening, wherein a number of the first rollers is at least two, and the first rollers are mounted on both sides of the anti-falling main body through a first roll shaft, wherein the second roller is mounted to a front surface of the anti-falling main body through a second roll shaft, and the second roll shaft is perpendicular to the first roll shaft, wherein one side away from the closing groove of the second roller is provided with a wear plate, wherein the second roll shaft is fixed to the lifting vehicle by sequentially penetrating through the anti-falling main body, the second roller, a first positioning sleeve and the wear plate; the wear plate is mounted to the second roll shaft through the first positioning sleeve.

2. The lifting equipment of claim 1, wherein a first elastic member capable of extending and retracting along a second roll shaft direction is arranged between the second roller and the anti-falling main body.

3. The lifting equipment of claim 2, wherein the second roller is connected to an upper portion of the anti-falling main body, and a lower portion of the anti-falling main body is provided with a second positioning sleeve, the second positioning sleeve is mounted to the front surface of the anti-falling main body through a third roll shaft which is parallel to the second roll shaft, and a second elastic member capable of extending and retracting along a length direction of the third roll shaft is arranged between the second positioning sleeve and the anti-falling main body.

4. The lifting equipment of claim 1, wherein one side facing the climbing member of the guide rail is provided with friction protrusions.

5. The lifting equipment of claim 1, wherein a top portion of the guide rail is mounted with guiding pulleys for a traction rope, and a bottom portion of the guide rail is provided with a tensioning device for the traction rope.

6. The lifting equipment of claim 1, wherein the lifting vehicle is connected to the one or more traction ropes, and the climbing member is provided with a traction rope protection assembly, wherein the traction rope protection assembly comprises idler rollers and a mounting bracket for mounting the idler rollers to the climbing member, and wherein a rotation direction of the idler rollers is perpendicular to a lifting direction of the one or more traction ropes, and the idler rollers are between the climbing member and the one or more traction ropes.

7. The lifting equipment of claim 1, wherein a double-hand switch is provided on the lifting vehicle.

8. The lifting equipment of claim 1, wherein the controller of the traction machine is connected to a bus of the controller, and the bus of the controller is provided with a resistance module.

9. A lifting equipment comprising a traction machine, a climbing member, a guide rail, a lifting vehicle, and a stall braking device mounted on the lifting vehicle, wherein the traction machine comprises:

one or more traction pulleys;

first and second fixed pulleys for changing directions of one or more traction ropes;

the one or more traction ropes driven by the one or more traction pulleys and the first and second fixed pulleys, wherein the first fixed pulley is provided with a sensor sensing member rotating with the first fixed pulley;

a traction machine sensor arranged beside the first fixed pulley, the traction machine sensor configured to detect a rotation speed of the sensor sensing member, and send the detected rotation speed data to the traction machine;

a controller in the traction machine that receives the detected rotation speed data and controls a rotation of the one or more traction pulleys according to the detected rotation speed data of the traction machine sensor, wherein the controller and the traction machine sensor detect whether the one or more traction ropes are slipping or whether an operating speed is normal, and in response to detecting the traction machine has an abnormal operation, stop the abnormal operation of the traction machine, wherein the guide rail is arranged on the climbing member, the stall braking device comprises a speed-limiting assembly and a safety protection assembly, wherein the speed-limiting assembly comprises a speed measuring wheel, a centrifugal block and a braking cam, wherein the centrifugal block is fixed to the speed measuring wheel and rotates with the speed measuring wheel, and when a rotation speed of the speed measuring wheel is not less than a set speed, the centrifugal block opens and connects the braking cam so as to drive the braking cam to rotate, wherein the speed measuring wheel and the centrifugal block are fixedly mounted on a main shaft, and the speed measuring wheel drives the centrifugal block to rotate through the main shaft, wherein the braking cam is fixedly mounted on a transmission shaft, and the centrifugal block is connected to the transmission shaft through a transmission sleeve when opened.

10. The lifting equipment of claim 9, wherein the main shaft is provided with a first through hole in a radial direction, wherein after a centrifugal spring passes through the first through hole, each of two ends of the centrifugal spring is fixed with a centrifugal block respectively; lugs are formed on the main shaft, and the lug is provided with a second through hole extending axially along the main shaft, and wherein the centrifugal block is hinged to the second through hole through a pin shaft, so that the centrifugal block rotates with the second through hole as an axis and opens.

11. The lifting equipment of claim 10, wherein a first circumferential limiting member is formed on an outer surface of the centrifugal block, and a second circumferential limiting member is formed on an inner surface of the transmission sleeve, and wherein when the centrifugal block opens, the first circumferential limiting member and the second circumferential limiting member are circumferentially locked.

12. The lifting equipment of claim 11, wherein the outer surface of the centrifugal block comprises two first involute surfaces, and the first circumferential limiting member is formed between the first involute surfaces, wherein the inner surface of the transmission sleeve comprises two second involute surfaces, and the second circumferential limiting member is formed between the second involute surfaces.

13. The lifting equipment of claim 9, wherein the safety protection assembly comprises a locking block hinged on the lifting vehicle, wherein when the lifting vehicle operates normally, the locking block compresses a spring, and wherein when the lifting vehicle stalls, the spring ejects the locking block so that the locking block is embedded in a locking hole of the guide rail.

14. The lifting equipment of claim 9, wherein the controller of the traction machine is connected to a bus of the controller, and the bus of the controller is provided with a resistance module.

15. A lifting equipment, comprising: a traction machine, a climbing member, a guide rail a lifting vehicle, and wherein the guide rail is arranged on the climbing member, wherein the traction machine comprises:

one or more traction pulleys;

first and second fixed pulleys for changing directions of one or more traction ropes;

the one or more traction ropes driven by the one or more traction pulleys and the first and second fixed pulleys, wherein the first fixed pulley is provided with a sensor sensing member rotating with the first fixed pulley;

a traction machine sensor arranged beside the first fixed pulley, the traction machine sensor configured to detect a rotation speed of the sensor sensing member, and send the detected rotation speed data to the traction machine;

a controller in the traction machine that receives the detected rotation speed data and controls a rotation of the one or more traction pulleys according to the detected rotation speed data of the traction machine sensor, wherein the controller and the traction machine sensor detect whether the one or more traction ropes are slipping or whether an operating speed is normal, and in response to detecting the traction machine has an abnormal operation, stop the abnormal operation of the traction machine;

wherein the guide rail is provided with a closing groove extending along a longitudinal direction of the guide rail, and an anti-falling device capable of ascending and descending along the guide rail is mounted on the lifting vehicle, the anti-falling device comprises an anti-falling main body embedded in the closing groove, the anti-falling main body is provided with first rollers in the closing groove and capable of sliding along an inner wall of the closing groove, wherein the anti-falling device further comprises a second roller arranged at an opening of the closing groove and capable of sliding along the opening, wherein triggering blocks are arranged on the climbing member or the guide rail corresponding to places where space changes, and wherein when the lifting vehicle runs to the triggering block, the triggering block sends current position information to the controller of the traction machine, and the controller controls an operating speed of the lifting vehicle according to the position information.

16. The lifting equipment of claim 15, wherein the controller of the traction machine is connected to a bus of the controller, and the bus of the controller is provided with a resistance module.

17. The lifting equipment of claim 15, wherein one side facing the climbing member of the guide rail is provided with friction protrusions.

18. The lifting equipment of claim 15, wherein a top portion of the guide rail is mounted with guiding pulleys for a traction rope, and a bottom portion of the guide rail is provided with a tensioning device for the traction rope.

19. The lifting equipment of claim 15, wherein the lifting vehicle is connected to the one or more traction ropes, and the climbing member is provided with a traction rope protection assembly, wherein the traction rope protection assembly comprises idler rollers and a mounting bracket for mounting the idler rollers to the climbing member, and wherein a rotation direction of the idler rollers is perpendicular to a lifting direction of the one or more traction ropes, and the idler rollers are between the climbing member and the one or more traction ropes.

20. The lifting equipment of claim 15, wherein a double-hand switch is provided on the lifting vehicle.

* * * * *